US006203190B1

(12) United States Patent
Stotz

(10) Patent No.: US 6,203,190 B1
(45) Date of Patent: Mar. 20, 2001

(54) CROWN SWITCHING MECHANISM

(75) Inventor: Gerhard Stotz, Eisingen (DE)

(73) Assignee: Timex Corporation, Middlebury, CT (US)

( * ) Notice: Subject to any disclaimer, the term of this patent is extended or adjusted under 35 U.S.C. 154(b) by 0 days.

(21) Appl. No.: 09/327,769

(22) Filed: Jun. 7, 1999

(51) Int. Cl.[7] ..... G04B 29/00
(52) U.S. Cl. ..... 368/320; 368/190
(58) Field of Search ..... 368/319–321, 368/190, 188, 196

(56) References Cited

U.S. PATENT DOCUMENTS

| | | | | |
|---|---|---|---|---|
| 3,874,162 | | 4/1975 | Boxberger et al. | 58/34 |
| 4,031,341 | | 6/1977 | Wuthrich et al. | 200/52 R |
| 4,209,976 | | 7/1980 | Flumm | 368/187 |
| 4,283,784 | | 8/1981 | Horan | 368/87 |
| 4,419,018 | * | 12/1983 | Meyrat | 368/69 |
| 4,720,823 | * | 1/1988 | Terzian | 368/190 |
| 4,773,051 | * | 9/1988 | Soltermann | 368/321 |
| 4,780,864 | | 10/1988 | Houlihan | 368/10 |
| 4,783,773 | | 11/1988 | Houlihan et al. | 368/108 |
| 5,083,300 | | 1/1992 | Schwartz | 368/185 |
| 5,644,553 | | 7/1997 | Cuinet | 368/320 |

* cited by examiner

*Primary Examiner*—Bernard Roskoski
(74) *Attorney, Agent, or Firm*—Carmody & Torrance LLP

(57) ABSTRACT

A switching mechanism is provided for a multimode electronic timepiece having a casing, a device for indicating a time-of-day and an integrated circuit operable in a plurality of modes. The switching mechanism includes a setting stem mounted for rotational movement and positionable in a plurality of axial setting positions. The setting stem includes at least one tooth. The switching mechanism also includes a switch arm having a first end, a second end and an intermediate portion. The intermediate portion engages the tooth of the setting stem. The switching mechanism further includes a first and a second electrical contact. When the setting stem is in at least one of the axial setting positions and while the timepiece is operating in at least two of the modes, the intermediate portion cooperates with the tooth to intermittently form, in response to a rotation of the setting stem, an electrical connection between the second end and, when the setting stem is rotating in a first direction, the first electrical contact to produce an intermittent first electrical pulse. Alternatively, when the setting stem is rotating in a second direction, an electrical connection is intermittently formed between the second end and the second electrical contact to produce an intermittent second electrical pulse. In one embodiment, the intermittent first and second electrical signals are inputs to setting functions performed within at least one of the modes of the timepiece.

14 Claims, 10 Drawing Sheets

CROWN SWITCHING MECHANISM

CROSS-REFERENCE TO RELATED APPLICATIONS

This patent application is related to commonly assigned, copending U.S. patent application Ser. No. 09/264,523, filed on Mar. 8, 1999, entitled "Combined Crown and Pusher Electro Mechanism," by Michel G. Plancon.

FIELD OF THE INVENTION

This invention relates generally to electronic devices such as digital timepieces, combined analog and digital timepieces, and analog timepieces with electrosetting. More particularly, this invention relates to an improved switching mechanism for the digital timepieces, the combined analog and digital timepieces, and the analog timepieces with electrosetting.

BACKGROUND OF THE INVENTION

In general, an analog timepiece includes a watch case, a movement disposed in the watch case having a stepping motor which drives gear trains to operate time indicating hands, a dial, a device for illuminating the dial, a rotatable stem slidably disposed in the movement, a crown actuator disposed on the stem external to the watch case for manually rotating and sliding the stem, and a setting pinion disposed on the stem and adapted to engage the gear train when the stem is pulled from a normal "run" position to a "set" position. The crown actuator, the stem and the setting pinion may comprise what is termed a "crown setting mechanism." When in the "set" position, the crown setting mechanism is manually operated so that the setting pinion on the stem engages teeth of a setting gear which meshes with the gear train. In this way the time indicating hands may be rotated by rotating the crown actuator to set the time. An example of such an arrangement is seen in U.S. Pat. No. 5,083,300 issued Jan. 21, 1992 to Schwartz and assigned to the assignee of the present invention.

As is also known in the art, the crown setting mechanism may cooperate with the device for illuminating the dial such that when the stem is pushed from the normal "run" position to a "switching" position, the dial is illuminated. A commonly assigned, U.S. Pat. No. 5,644,553 issued Jul. 1, 1997 to Cuinet describes an example of such a combined crown and pusher. The disclosures of commonly assigned, U.S. Pat. Nos. 5,083,300 and 5,644,553 are incorporated by reference herein in their entireties.

On the other hand, a digital timepiece includes a display, a lamp for illuminating the display, manually actuatable switches (referred to hereinafter as pushers), and an integrated circuit. As is well known, the digital timepiece may have multiple operating modes such as, for example, a time-of-day (TOD) mode, a chronograph (CHRONO) mode, an alarm setting (ALARM) mode, an elapsed timer (TIMER) mode, and an alternate time zone (T2) mode. Generally, one of a plurality of the pushers is activated to change from one operating mode to another. Another one or more of the plurality of the pushers may be activated to change information being displayed during a currently activated operating mode. By example, in the ALARM mode a first pusher is actuated to select a numeric position on the display. A second pusher is actuated to sequence the numeric position through a predetermined series of numbers (e.g., 0–9) which appear on the display. To select a number within the series to represent a current value of the numeric position on the display, the second pusher is released. The first pusher is actuated again to deselect the currently selected numeric position and to select a next numeric position on the display. In this way a particular time-of-day can be specified at which time an audible alarm is activated. Examples of such multi-mode, multi-functioning electronic timepieces include commonly assigned, U.S. Pat. No. 4,783,773 issued Nov. 8, 1988 to Houlihan et al., U.S. Pat. No. 4,780,864 issued Oct. 25, 1988 to Houlihan and U.S. Pat. No. 4,283,784 issued Aug. 11, 1981 to Horan. The disclosure of these commonly assigned, U.S. Pat. Nos. 4,783,773, 4,780,864, and 4,283,784 are incorporated by reference herein in their entireties.

As the number of available operating modes and information to be displayed and set during each operating mode increases, there is likewise an increase in the number of pushers needed to activate the modes and/or set the information displayed therein. While the increasing number of modes increase the complexity of use, the increase in the number of pushers may lessen the aesthetic appeal of the timepiece. For example, the complexity in use may increase due to the need to identify which one of the pushers should be actuated to cycle through the various operating modes and/or information displayed in one of the operating modes. The increased complexity can be frustrating to a user of the timepiece.

The inventor of the present invention has realized that the setting functions performed with the crown setting mechanism of the analog timepiece are more intuitive for users than the setting functions performed with the plurality of pushers of conventional digital timepieces.

Commonly assigned, U.S. Pat. No. 3,874,162 issued Apr. 1, 1975 to Boxberger et al. ('162 patent) and U.S. Pat. No. 4,031,341 issued Jun. 21, 1977 to Wuthrich et al. describe dual function pushers and rotating switch assemblies for activating features of digital, electronic watches. For example, the '162 patent describes a stem detent and switch assembly which may provide a four position rotary detent action to advance or reset hour, minute and second counters, to select an operating mode, or to shut down the digital watch.

In commonly assigned U.S. Pat. No. 4,209,976 issued Jul. 1, 1980 to Flumm ('976 patent), a rotatable switch mechanism having a single gear-toothed wheel mounted on a rotatable and axially moveable stem, a switch assembly and circuitry for actuating time correction, is described. The switch assembly includes a first and a second switch contact and a central switch blade disposed therebetween. The central switch blade is precisely positioned within a periphery of the teeth of the single gear-toothed wheel. As the stem is rotated, the teeth of the single gear-toothed wheel deflect the central switch blade to strike either of the first or the second switch contacts. The time correction circuitry detects the striking of the switch blade and one of the switch contacts and, in response thereto, increments or decrements a displayed time based on a respective contact. For example, the striking of the first contact as a result of a clockwise rotation of the stem increments the displayed time, whereas the striking of the second contact as a result of a counter-clockwise rotation of the stem decrements the displayed time.

A perceived disadvantage in the '976 patent is the precise alignment required between the single gear-toothed wheel, the central switch blade, the first contact and the second contact to activate the time correction circuitry. That is, a misalignment in the described configuration of these components due, for example, to varying manufacturing tolerances, would result in a failure of the switch mechanism of the '976 patent.

In contrast to the prior art, the present invention provides a crown switching mechanism which utilizes a minimum of associated parts, a plurality of axial setting positions and a configuration of components to improve the manual control of and operations associated with time correction. The present invention further minimizes the effects of manufacturing tolerances in components used to activate time correction circuitry.

Therefore, a crown switching mechanism that overcomes the aforementioned differences and achieves the following advantages is desired and is provided by the present invention.

OBJECTS AND ADVANTAGES OF THE INVENTION

Therefore, it is a first object and advantage of this invention to provide an improved crown switching mechanism for electronic devices and, particularly, for digital timepieces, combination analog and digital timepieces, and analog timepieces with electrosetting that overcomes the foregoing and other problems.

It is another object and advantage of this invention to provide a crown switching mechanism having a predetermined number of axial setting positions and having a predetermined number of rotational setting positions to perform selective setting functions for an electronic device.

It is a further object and advantage of this invention to provide a crown switching mechanism for generating setting signals in response to selective axial and rotational movements of a setting stem of the crown switching mechanism.

Further objects and advantages of this invention will become more apparent from a consideration of the drawings and ensuing description.

SUMMARY OF THE INVENTION

The foregoing and other problems are overcome and the objects and advantages are realized by methods and apparatus in accordance with embodiments of this invention, wherein an improved crown switching mechanism for a multimode, electronic device is disclosed.

Generally speaking, a switching mechanism is provided for a multimode, electronic device such as, for example, a timepiece of the type having a casing, means for indicating a time-of-day, and an integrated circuit. The integrated circuit performs timekeeping related functions including providing at least the time-of-day. The integrated circuit is operable in a plurality of modes. At least one of the plurality of modes includes operations to set the time-of-day.

Preferably, the switching mechanism includes a setting stem that is mounted in an opening through the case and, particularly, mounted for rotational movement and operatively positionable in a plurality of axial setting positions in response to axial movement of the setting stem. The setting stem includes at least one tooth disposed thereon. The switching mechanism also includes a switch arm spaced apart from the setting stem. The switch arm includes a first end fixedly coupled within a cavity of a body portion of the switching mechanism, a second end and an intermediate portion between the first and the second ends. The intermediate portion engages the at least one tooth of the setting stem. The switching mechanism further includes a first electrical contact and a second electrical contact spaced apart from the first electrical contact.

When the setting stem is in a first of the plurality of axial setting positions, the electronic timepiece is in a first mode and the intermediate portion is intermittently engagable with the at least one tooth. When engaged, the second end of the switch arm is deflected thereby causing an electrical connection between the second end and at least one of the first and the second electrical contacts. Similarly, when the setting stem is in a second of the plurality of axial setting positions, the electronic timepiece is in at least a second mode and the intermediate portion is intermittently engagable with the at least one tooth. The intermittent engagement causing deflection of the second end of the switch arm thereby forming an electrical connection between the second end and at least one of the first and the second electrical contacts.

When the setting stem is in one of the first and the second axial positions and rotated in a first direction, the intermediate portion intermittently engages the at least one tooth causing, as noted above, deflection of the second end of the switch arm. The deflections resulting in intermittent electrical connections between the second end and the first electrical contact. When the setting stem is rotated in a second direction, the intermediate portion intermittently engages the at least one tooth causing deflection of the second end of the switch arm thereby causing intermittent electrical connections between the second end and the second electrical contact. The intermittent electrical connections between the second end and the first electrical contact produces intermittent first electrical pulses and the intermittent electrical connections between the second end and the second electrical contact produces intermittent second electrical pulses.

In a preferred embodiment, the intermittent first and second electrical signals are inputs to setting functions performed within at least one of the plurality of modes of the electronic device. For example, the intermittent first electrical pulses may increment a value through a predefined series of values during the at least one setting function, while the intermittent second electrical pulses may decrement a value through a predefined series of values during the at least one setting function. In the preferred embodiment, the crown switching mechanism is a combination push, pull and rotate switching mechanism which generates input signals during setting functions of a multimode electronic timepiece.

Clearly patentably distinguishing the present invention from the prior art is the construction of the setting stem and the switch arm which permits selective engagement between the setting stem and the switch arm while the setting stem is in a plurality of axial setting positions.

BRIEF DESCRIPTION OF THE DRAWINGS

The above set forth and other features of the invention are made more apparent in the ensuing Detailed Description of the Preferred Embodiments when read in conjunction with the attached Drawings, wherein.

Identically labeled elements appearing in different ones of the above described figures refer to the same elements but may not be referenced in the description for all figures.

DETAILED DESCRIPTION OF THE PREFERRED EMBODIMENTS

The present invention discloses an improved crown switching mechanism for multimode, electronic devices and, in particular, a combination push, pull and rotate switching mechanism for digital timepieces, combined analog and digital timepieces, and analog timepieces with electrosetting. As can be appreciated, the digital timepieces, the combined analog and digital timepieces, and the analog timepieces with electrosetting are well known in the art. For example, these timepieces are described in commonly assigned, U.S. Pat. No. 4,783,773 issued Nov. 8, 1988 to Houlihan et al., U.S. Pat. No. 4,780,864 issued Oct. 25, 1988 to Houlihan and U.S. Pat. No. 4,283,784 issued Aug. 11, 1981 to Horan. The disclosure of commonly assigned, U.S. Pat. Nos. 4,783,773, 4,780,864 and 4,283,784 are incorporated by reference herein in their entireties.

Figure 1:
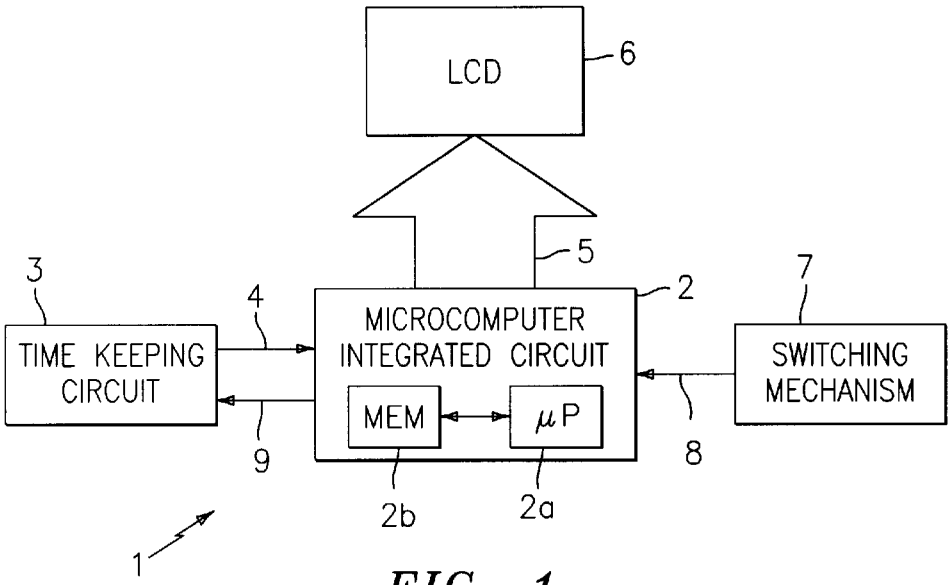
FIG. 1 is a block diagram of an integrated circuit and other components of a multimode, multifunctioning electronic device constructed in accordance with the present invention.

FIG. 1 is a schematic block diagram illustrating components of watch circuitry 1 of a multimode, multifunctioning electronic timepiece configured in accordance with the present invention. For simplicity and clarity, and since the general construction and timekeeping functions of electronic timepieces are well known in the art as is evidenced by the above-described U.S. patents, FIG. 1 illustrates a simplified diagram wherein not all components of the circuitry 1 are shown.

In FIG. 1 the watch circuitry 1 includes a programmable microcomputer 2 in the form of, for example, an integrated circuit chip that is bonded to a printed circuit board (PCB) (not shown). The microcomputer 2 includes a microprocessor ($\mu$P) 2*a* programmed to perform instructions suitable for achieving the timekeeping functions of the electronic timepiece and a memory device (MEM) 2*b*. As can be appreciated, the watch circuitry 1 also includes a timekeeping circuit 3 which generates a time indicating signal 4 representing a time-of-day. The microcomputer 2 receives the time indicating signal 4 and, in at least one operating mode, processes the signal 4 to provide an output signal over a display bus 5 to a display such as, for example, a liquid crystal display (LCD) 6. The LCD 6 exhibits the time-of-day and/or other numbers, letters or symbols as instructed by the microcomputer 2. As is generally known, the display bus 5 represents several parallel leads to activate various segments of the LCD 6. It should also be understood that in an alternate embodiment the LCD 6 may be replaced by a dial having hands which are operable for indicating the time-of-day.

During setting functions of at least one operating mode of the timepiece, information exhibited on the display 6 may be set or reset. In accordance with the present invention, a switching mechanism 7 is operable to generate input signals 8 to the microcomputer 2 during predetermined setting functions. The input signals 8 are passed to the $\mu$P 2*a* for processing to, for example, increase or decrease a value exhibited on the display 6 through a predetermined sequence of values. In one embodiment, the predetermined sequence of values may be stored in the MEM 2*b*. As such, the $\mu$P 2*a* retrieves the stored sequence of values prior to receipt of the input signals 8. In another embodiment, the input signals 8 may also be processed to set or reset a value or values within the timekeeping circuit 3. In this regard, a control signal 9 may be directed to the timekeeping circuit 3 from the microcomputer 2 (i.e. the $\mu$P 2*a*) to set one or more values within the timekeeping circuit 3.

Figure 2:
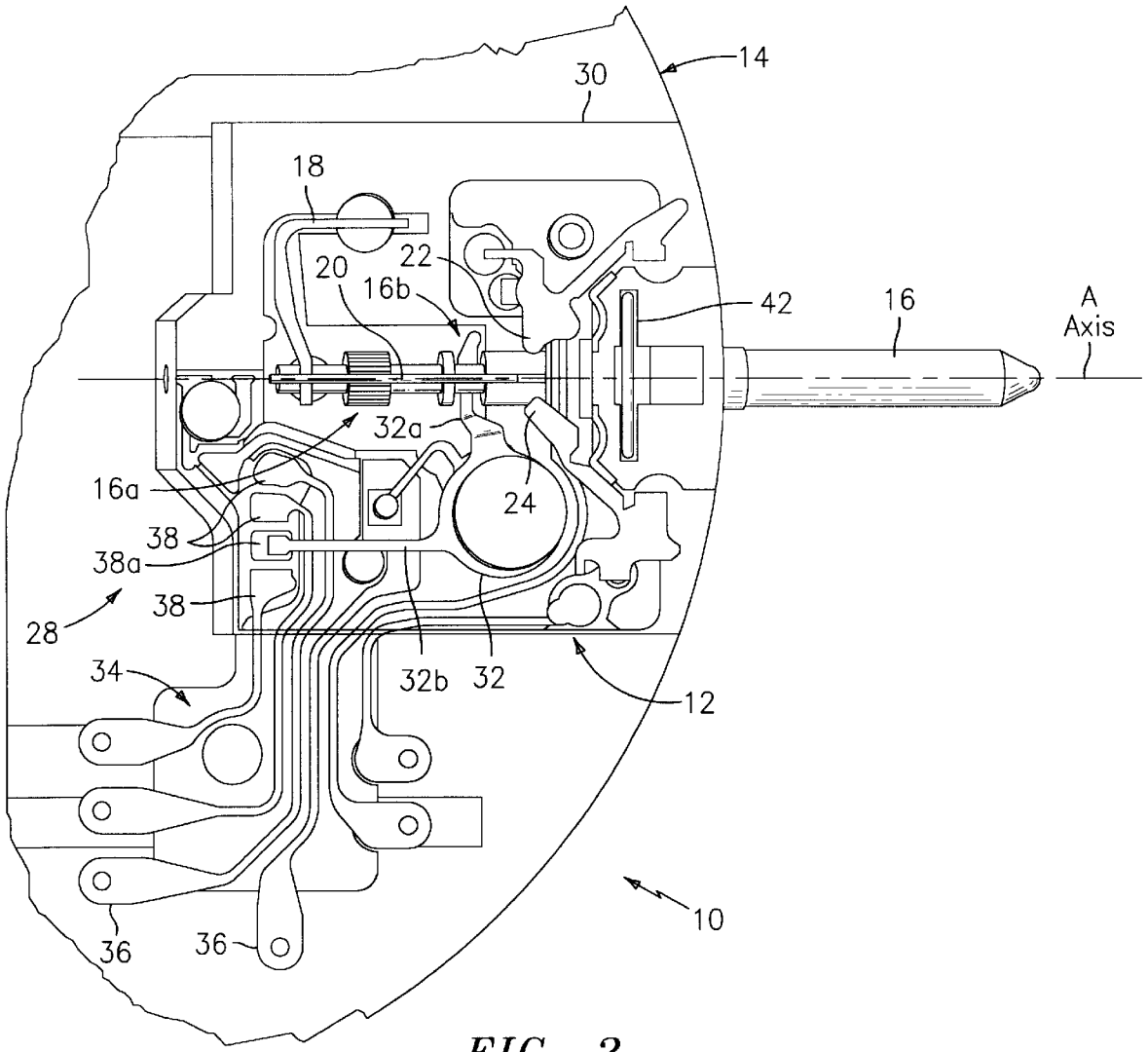
FIG. 2 is a plan view from a back, or movement, side of the electronic device of FIG. 1.

In FIG. 2, a multimode, multifunctioning electronic timepiece 10 includes a watch movement frame 14 located within a watch case (not shown). The movement frame 14 includes a cavity containing the watch circuitry 1 of FIG. 1. The general construction and timekeeping functions of the multimode, multifunctioning electronic timepiece 10 are well known in the art, as is described in the above-referenced, commonly assigned U.S. patent applications, and therefore, are not described in further detail herein.

As shown in FIG. 2, the electronic timepiece 10 includes the switching mechanism 7, that is, a crown switching mechanism generally indicated at 12, for selectively activating various timekeeping related functions of the timepiece 10 and, particularly, for performing setting or resetting functions within a current operating mode of the timepiece 10. The crown switching mechanism 12 is mounted on the movement frame 14 using conventional means such as, for example, screws, and the movement frame 14 is then disposed within the watch case of the timepiece 10.

The crown switching mechanism 12 preferably includes a setting stem 16 and a switching device. The setting stem 16 extends through a bore of the watch case. A detent spring 42 engages a plurality of ring-shaped grooves (discussed in detail below) of the setting stem 16 to achieve a plurality of axial setting positions and to prohibit an accidental complete withdrawal of the setting stem 16 from the watch case. At a first end of the setting stem 16, which is disposed within the watch case, is a spring plate 18. The spring plate 18 engages the first end of the stem 16 and biases, or "loads", the stem 16 to allow a "pushed" axial setting position similar in operation to that of a push button. At a second end of the setting stem 16, which is located outside of the watch case, is preferably fitted a knob or crown (not shown) which is manually manipulated to slide the stem 16 axially within the plurality of axial setting positions.

The plurality of axial setting positions may include, for example, a normal "run" position, a "push" or "switch"

position, a first pulled or "time setting" position, and a second pulled or "alternate setting" position. In the normal "run" position, the setting features of the timepiece 10 may not be activated, rather, the timepiece 10 is operative to display time-related information and to provide timekeeping functions. In the "push" position, the setting stem 16 cooperates with a position indicating device, shown generally as 28 and discussed in detail below, to activate a feature of the timepiece such as, for example, illuminating the display. In the first and the second pulled positions setting or resetting functions of the timepiece 10 may be performed.

The switching device preferably includes a spring switch arm 20, a first electrical contact 22 and a second electrical contact 24. At a first end, the spring switch arm 20 is preferably fixedly attached (e.g., by soldering, screwing or otherwise fastening) to a body portion 30 of the switching mechanism 12 and is aligned with an axis of rotation of the setting stem 16 (shown in FIG. 2 as an axis A). The spring switch arm 20 is also aligned such that a second end, which is opposite the first end, is disposed between the first electrical contact 22 and the second electrical contact 24.

Figure 7A:
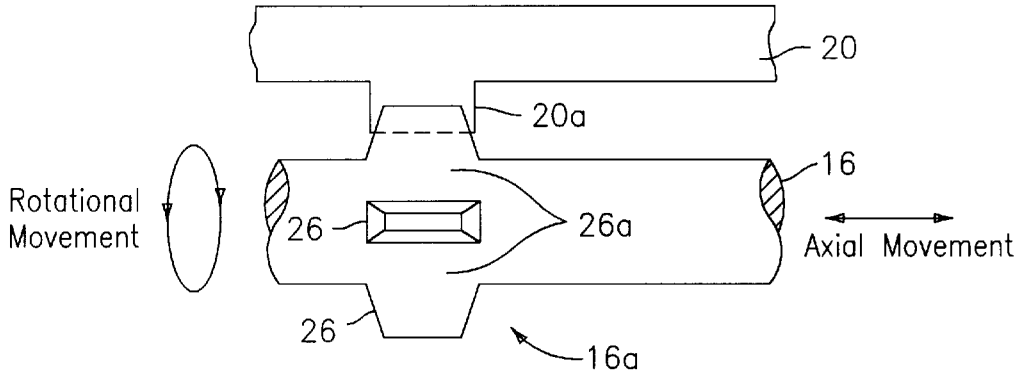
FIG. 7A is an enlarged, partial elevational view of the crown switching mechanism constructed in accordance with one embodiment of the present invention.
Figure 7B:
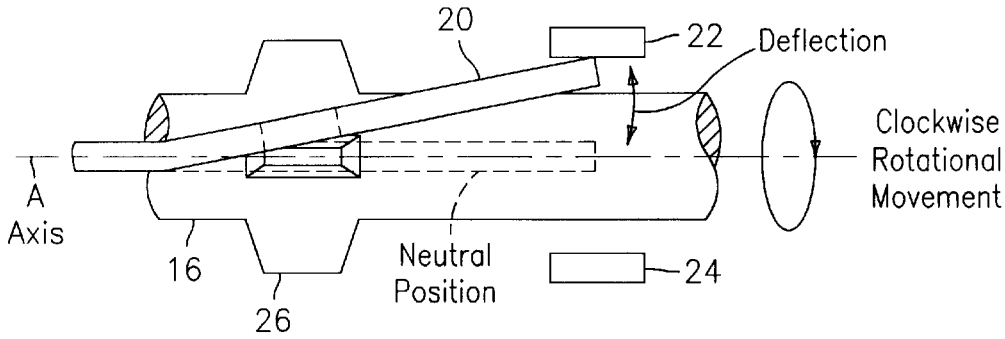
FIG. 7B is an enlarged, plan view of the crown switching mechanism of FIG. 7A which illustrates an incremental generation of electrical pulses.

In accordance with the present invention and as shown in FIGS. 7A and 7B, the setting stem 16 includes a first portion 16*a* which may have, in accordance with the preferred embodiment, a plurality of integrally formed teeth 26 disposed about an outer diameter of the setting stem 16. As the setting stem is rotated, the plurality of integrally formed teeth 26 cooperate with the spring switch arm 20 to cause intermittent engagement between the spring switch arm 20 and the first electrical contact 22 or the second electrical contact 24. As a result of the engagement, an electrical connection is formed between the spring switch arm 20 and a respective one of the first electrical contact 22 and the second electrical contact 24 to produce an electrical pulse. The electrical pulse may be used by the circuitry 1 (FIG. 1) as an input (e.g., input signals 8) to a predetermined setting function.

In the present invention, as the setting stem 16 is continuously rotated in, for example, a first, clockwise direction, the teeth 26 of the setting stem 16 engage and deflect the spring switch arm 20 from a neutral position in a common plane as the axis of rotation (the A axis) to a position in which the second end of the spring switch arm 20 engages the first electrical contact 22 (FIG. 7B). A continuous rotation and the resulting intermittent engagement produces a series of first electrical pulses (as described below) which can be used as an input signal to a predetermined setting function.

In one aspect of the present invention, illustrated in FIGS. 7A and 7B, the spring switch arm 20 has an intermediate portion 20*a* which projects from the spring switch arm 20 to a space 26*a* between respective ones of the plurality of teeth 26. As the setting stem 16 is continuously rotated the teeth 26 repeatedly deflect the intermediate portion 20*a* in the direction of rotation. As should be appreciated, the spring switch arm 20 is capable of flexible, or spring-like, action. As such, the second end of the spring switch arm 20 is deflected by the continuously rotated teeth 26 in the same direction as the intermediate portion 20*a*. For example, as the setting stem 16 is continuously rotated in a clockwise direction, the intermediate portion 20*a* is repeatedly deflected such that the second end of the spring switch arm 20 repeatedly engages the first electrical contact 22.

In accordance with the present invention, the number of the plurality of integrally formed teeth 26 of the setting stem 16 are optimized such that after the spring switch arm 20 is deflected by one of the teeth 26 to engage one of the electrical contacts 22 and 24, the switch arm 20 is released and, by virtue of the spring switch arm's flexible action, the spring switch arm 20 returns to its neutral position in the plane common to the A axis. As the spring switch arm 20 is released the electrical connection between the spring switch arm 20 and one of the electrical contacts 22 and 24 is broken. If the setting stem is continuously rotated, a next one of the teeth 26 deflects the spring switch arm 20 to engage one of the electrical contacts 22 and 24 and to form the electrical connection. The configuration of the teeth 26 may also permit the next one of the teeth 26 to act as an end stop for the spring switch arm 20 as it is released by a previous tooth and traveling towards its neutral position. Preferably, the number of teeth 26 to achieve this end stop action is seven teeth. The configuration of seven teeth 26 prevent an overswing of the spring switch arm 20 past the neutral position.

Additionally, it is within the scope of the present invention for the setting stem 16 to include other configurations of teeth 26. For example, the selection of the number of teeth 26 may correspond to a desired setting speed, that is, a rate at which values within the setting functions are incremented and decremented in relation to the rotational speed of the setting stem 16. The greater the number of teeth 26, the faster values may be incremented or decremented. In this regard, reference is made to the above-identified commonly assigned, copending U.S. patent application Ser. No. 09/264,523 by Michel Plancon wherein is disclosed a plurality of configurations of teeth of a click-wheel assembly and resulting electrical signal "signatures" (see, for example, FIGS. 9A–9D, 10A–10H and 11A–11D, and the portions of the specification referring thereto). The disclosure of this U.S. patent application Ser. No. 09/264,523 is incorporated by reference herein in its entirety.

As is appreciated by one skilled in the art, the above-described components cooperate to repeatedly form the electrical connection between the spring switch arm 20 and the electrical contacts 22 and 24 such that as the setting stem 16 is continuously rotated the engaging and releasing of respective teeth 26, the spring switch arm 20 and the electrical contacts 22 and 24 results in a series of electrical signals, or a pulsed, electrical signal. Thus, the greater the number of teeth 26, the more frequent the pulsed signal.

As was discussed above, the setting stem 16 is capable of axial movement within a plurality of axial setting positions. Thus, in one embodiment, the length of each of the teeth 26 are such that the teeth 26 are capable of engaging the intermediate portion 20*a* of the spring switch arm 20 in a plurality of axial setting positions, wherein in each of these plurality of positions, different time setting features are operational. In this regard, reference is now made to FIGS. 8A–8D wherein are illustrated four exemplary axial setting positions of the setting stem 16.

Figures 8A, 8B, 8C, 8D:
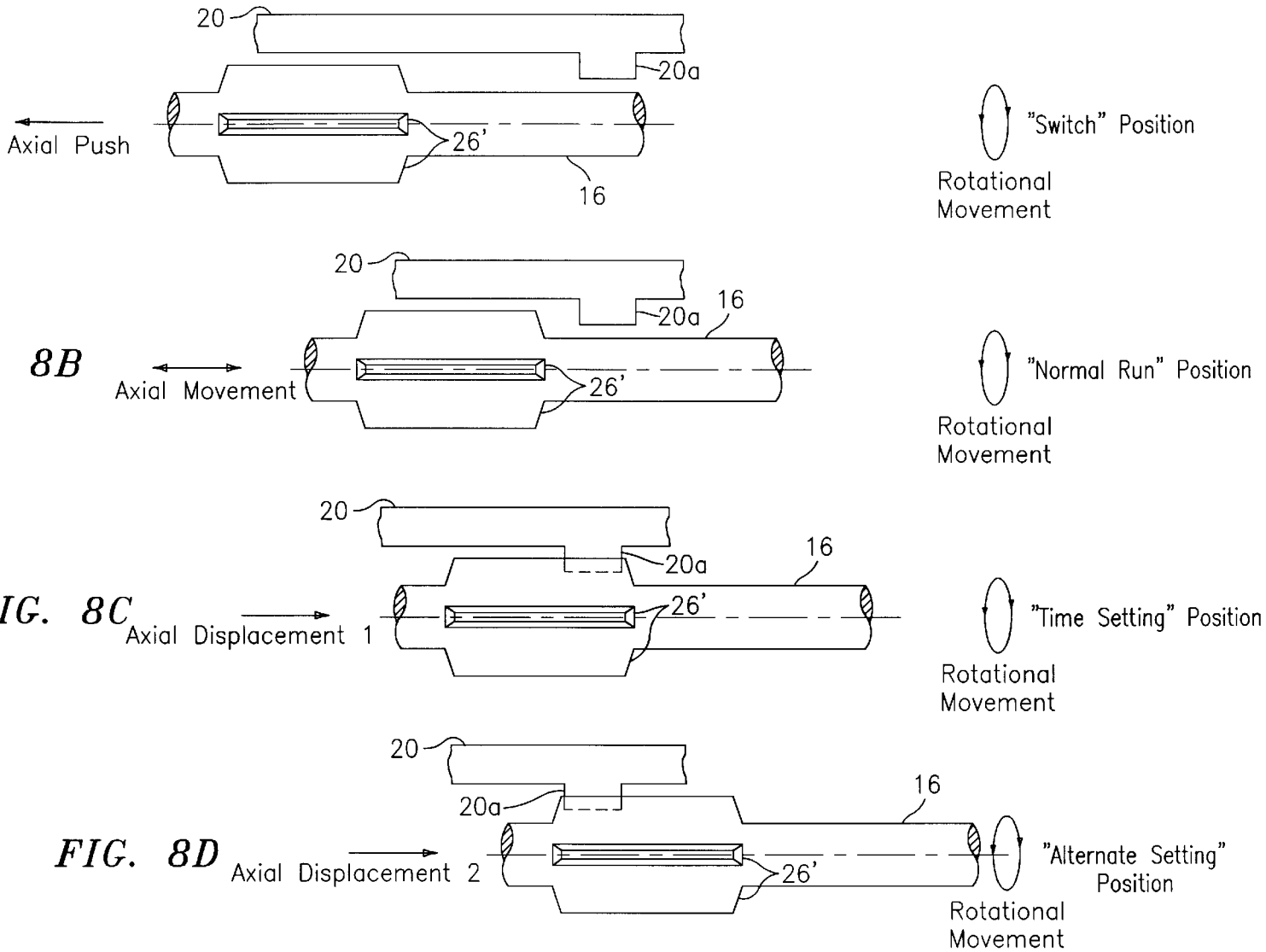
FIGS. 8A–8D are enlarged, partial elevational views of the crown switching mechanism constructed in accordance with another embodiment of the present invention and which illustrates a plurality of axial and rotational setting positions of the switching mechanism.

Specifically, FIGS. 8A–8D show the setting stem 16 in a pushed or "switch" position (FIG. 8A), a "normal run" position (FIG. 8B), a $1^{st}$ pulled or "time setting" position (FIG. 8C), and a $2^{nd}$ pulled or "alternate setting" position (FIG. 8D). In FIGS. 8A and 8B elongated teeth 26' do not engage the intermediate portion 20*a* of the spring switch arm 20. Thus, in the "switch" and the "normal run" axial setting positions a clockwise or a counterclockwise rotation of the setting stem 16 does not result in the generation of electrical signals. In FIGS. 8C and 8D, however, the length of the elongated teeth 26' are such that in both the "time setting" and "alternate setting" axial positions the elongated teeth 26' engage the intermediate portion 20*a* as the setting stem 16 is rotated resulting in the above described deflection and generation of the pulsed electrical signals.

Figure 8E:
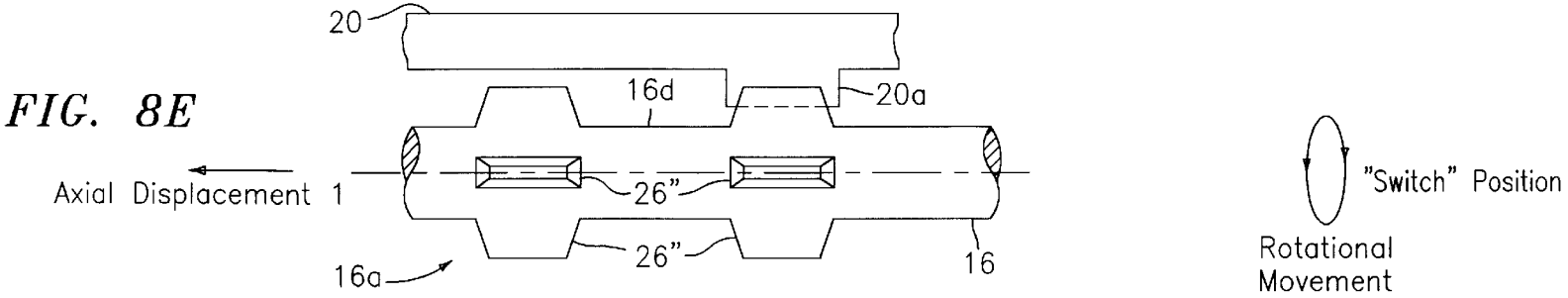
FIGS. 8E–8G are enlarged, partial elevational views of the crown switching mechanism constructed in accordance with yet another embodiment of the present invention.
Figure 8F:
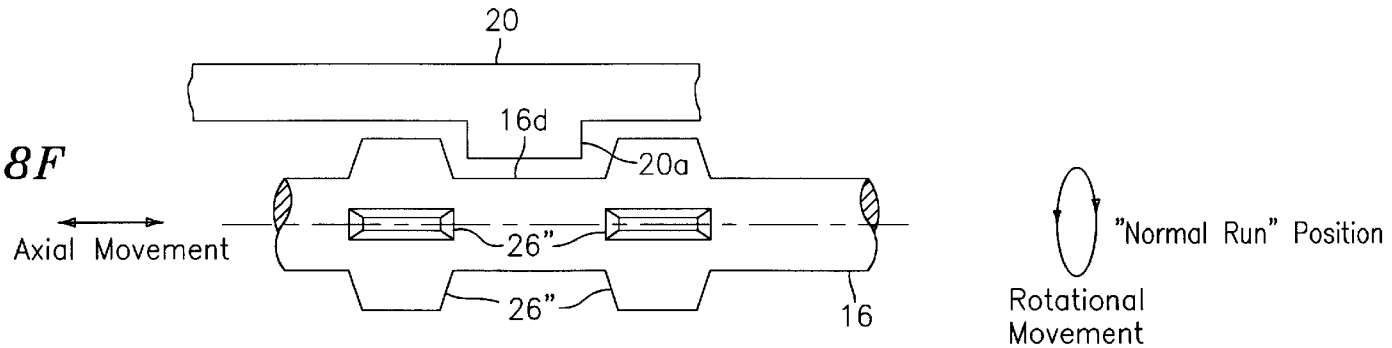
Figure 8G:
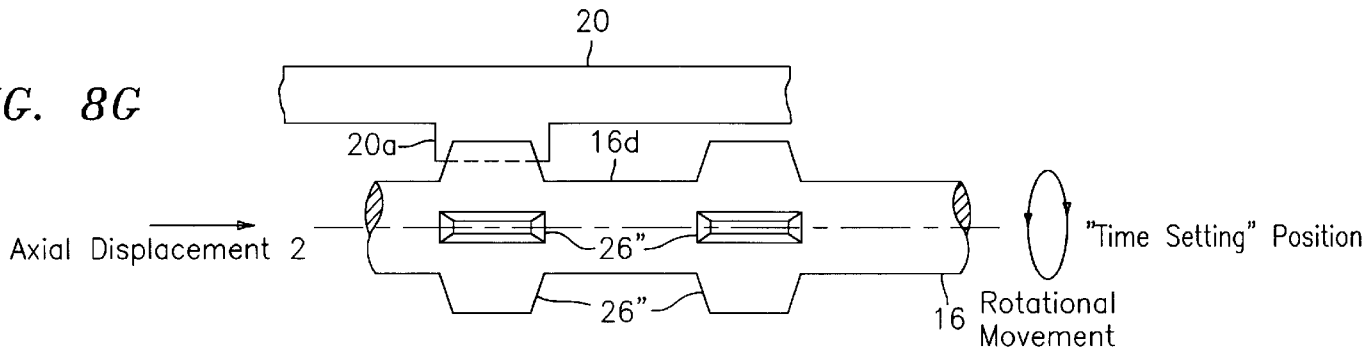

In an alternative embodiment (FIGS. 8E–8G), the teeth 26 of the setting stem 16 may include n sets of teeth located about a length of the setting stem 16. Preferably, n is an integer in a range of about 2 to 4, and corresponds to the number of axial setting positions implemented in the timepiece. In FIGS. 8E–8G, the n sets of teeth include two sets of teeth 26" separated by at least one smooth portion 16*d* of the setting stem 16. In accordance with the present invention, the configuration of the n sets of teeth 26" permit a selective engagement of the teeth 26" and the intermediate portion 20*a* within the plurality of axial setting positions. For example, in FIG. 8E a "switch" axial setting position for this embodiment of the present invention is shown. In FIG. 8E a first set of teeth 26" engage the intermediate portion 20*a* of the spring switch arm 20 as the setting stem 16 is rotated to generate the first and the second electrical signals as discussed above. In FIG. 8F a "normal run" axial setting position is shown wherein the intermediate portion 20*a* is disposed above the smooth portion 16*d* of the setting stem 16. As a result, in the "normal run" axial setting position, there is no engagement or deflection of the teeth 26", the intermediate portion 20*a* and, thus, the electrical connections needed to form the pulsed electrical signal are not present. When in the "time setting" position, illustrated in FIG. 8G, the rotation of the setting stem 16 results in the deflection of the intermediate portion 20*a* by the teeth 26". As such, the electrical signals are generated in response to the rotation of the setting stem 16.

As should be appreciated, alternate configurations of the n sets of teeth 26" permit the generation of the electrical signals within various ones of the axial setting positions. As such, the present invention describes the ability to selectively implement rotational setting positions within a plurality of axial setting positions.

Figure 9A:
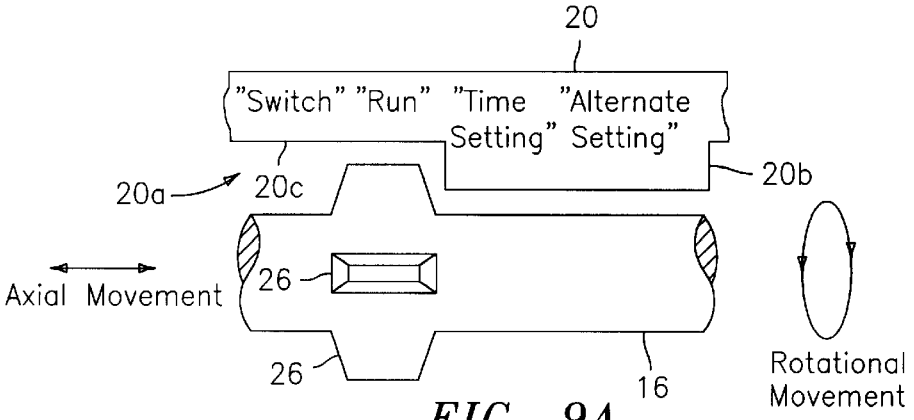
FIGS. 9A and 9B are enlarged, partial elevational views of the crown switching mechanism constructed in accordance with another embodiment of the present invention.
Figure 9B:
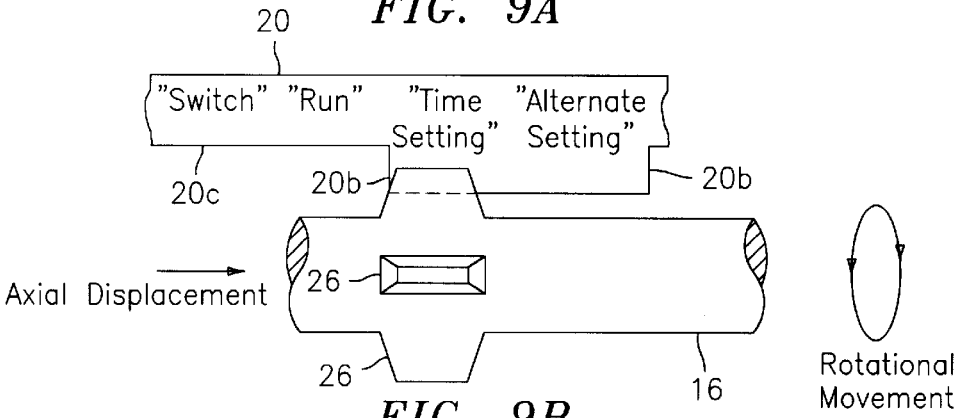

In another aspect of the present invention the intermediate portion 20*a* of the spring switch arm 20 is configured to selectively generate electrical signals within a predetermined number of the axial setting positions of the setting stem 16. In this embodiment the integrally formed teeth 26 are of a length sufficient to permit engagement with the intermediate portion 20*a* in only one of the axial setting positions at a time. The intermediate portion 20*a*, however, is configured to permit engagement within a number of the axial setting positions. For example, and with reference now to FIGS. 9A–9D, the intermediate portion 20*a* includes projecting portions 20*b* and smooth portions 20*c*. As shown in FIGS. 9A and 9B, the projecting portions 20*b* and the smooth portions 20*c* may be aligned within consecutive axial setting positions to effectively permit engagement between the teeth 26 and a portion of the intermediate portion 20*a* when the setting stem 16 is in the "time setting" and the "alternate setting" axial setting positions but not when the setting stem 16 is in the "switch" and the "normal run" axial setting position.

Figure 9C:
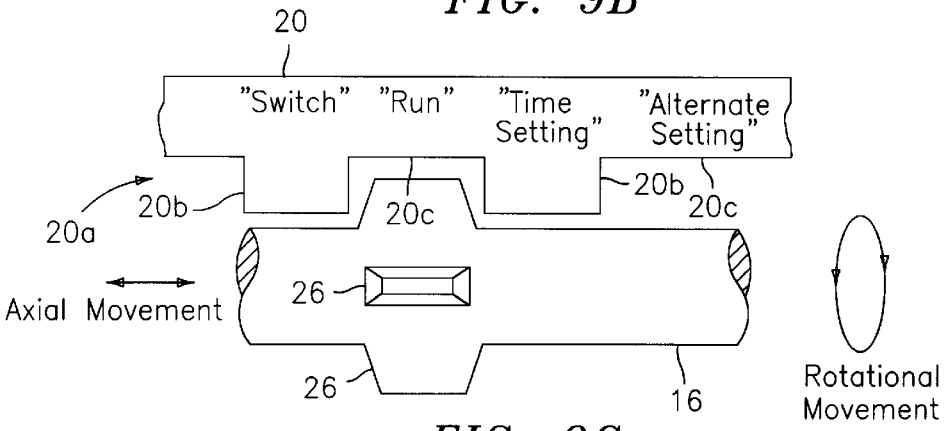
FIGS. 9C and 9D are enlarged, partial elevational views of the crown switching mechanism constructed in accordance with still another embodiment of the present invention.
Figure 9D:
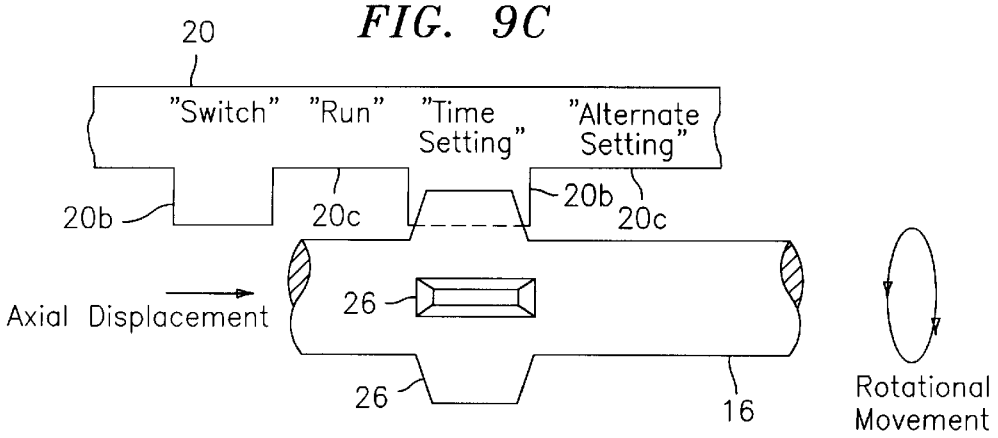

In another embodiment, illustrated in FIGS. 9C and 9D, the intermediate portion 20*a* includes alternating projecting portions 20*b* and smooth portions 20*c*. The projecting portions 20*b*, the smooth portions 20*c*, the integrally formed teeth 26, the axial movement of the setting stem 16 and the rotational movement of the setting stem 16 cooperate to selectively provide rotational setting positions to corresponding ones of the plurality of axial setting positions.

For example, in FIG. 9C, the setting stem 16 is disposed in the "normal run" axial setting position ("Run"). In this embodiment rotational movement of the setting stem 16 (when the setting stem 16 is in the "Run" position) does not result in the above described engagement of the teeth 26 and the intermediate portion 20*a*. That is, in the "normal run" position the teeth 26 are disposed in the at least one smooth portion 20*c* of the setting stem 16. As a result, the spring switch arm 20 is not deflected by the rotational movement of the setting stem 16 to engage either the first electrical contact 22 or the second electrical contact 24. However, when the setting stem 16 is axially displaced into, for example, the "time setting" axial setting position the integrally formed teeth 26 of the setting stem 16 will engage the at least one projecting portion 20*b* (FIG. 9D). Thus, as the setting stem 16 is rotated in the first direction, the teeth 26 deflect the at least one projecting portion 20*b* and the spring switch arm 20 engages the first electrical contact 22. Similarly, when the setting stem 16 is rotated in the second direction the teeth 26 of the setting stem 16 deflect the at least one projecting portion 20*b* and the spring switch arm 20 engages the second electrical contact 24.

As should be appreciated, the intermediate portion 20*a* of the spring switch arm 20 can be configured to add engagable projecting portions 20*b* to corresponding ones of the axial setting position. For example, FIGS. 9C and 9D also illustrate the "alternate setting" position (also referred to as a "seconded pulled" position) and the "pushed", or "switch", axial setting position. As shown, the "switch" position includes one of the protruding portions 20*b* while the "alternate setting" position includes one of the smooth portions 20*c*. As such, rotational setting positions can be achieved in the "switch" position but can not be achieved in the "alternate setting" position. As should be appreciated however, in an alternate embodiment (not shown), the "alternate setting" position can include one of the projecting portions 20*b*. In this alternate embodiment, any rotation of setting stem 16 would engage the arm 20 in the "alternate setting" position.

As was noted above, within each of the plurality of axial setting positions different setting functions are operational. Alternatively, we can view each of the plurality of axial positions in which the setting stem engages the intermediate portion as a different "mode," such as, for example, a "CHRONO" mode or a "TIMER" mode or a "TOD" mode of the timepiece. Importantly, this is a significant improvement over the prior art in that the prior art only described the ability to engage a flexible arm in one mode, and therefore did not provide the increased flexibility of use as provided herein.

Referring again to FIG. 2, the position indicating device 28 cooperates with the setting stem 16 to indicate to the circuitry 1 a currently selected one of the axial setting positions. The position indicating device 28 includes a function lever 32 which engages the setting stem 16 and in cooperation therewith indicates the currently selected one of the axial setting positions. For example, the setting stem 16 includes a second portion 16*b* having a reduced diameter or slot which retains a finger portion 32*a* of the function lever 32. When the setting stem 16 is axially displaced a predetermined distance, the finger portion 32*a* and, thus, the function lever 32 rotates or slides in response to the displacement. By detecting the displacement of the function lever 32 (as discussed below), the circuitry 1 of the timepiece 10 determines the currently selected one of the axial setting positions of the setting stem 16.

That is, as shown in FIGS. 2, 3, 5 and 6, the circuitry 1 includes a printed circuit board (PCB) 34 connected to the integrated circuit chip 2 (FIG. 1). The PCB 34 includes a plurality of contact terminals 38 connected to the integrated circuit chip 2 through printed circuit leads 36. In accordance with the present invention, and with reference now to FIG.

5, an indicating arm 32*b* of the function lever 32 contacts each respective one of the plurality of contact terminals 38 in a predefined manner when the setting stem 16 is in a predefined one of the axial setting positions described above. For example, contact terminal 38*a* may represent the normal "run" position, contact terminal 38*b* may represent the first "pulled" setting position, and contact terminal 38*c* may represent the "push" setting position. In accordance with this embodiment of the present invention, as the setting stem 16 axially moves, the indicating arm 32*b* electrically contacts the plurality of contact terminals 38. The circuitry 1 therefore functions based on the current position of the setting stem 16 within the plurality of axial setting positions. When the setting stem 16 is axially manipulated (e.g., pulled from the normal "run" position to the first "pulled" position), the function lever 32 rotates or slides and the indicating arm 32*b* travels from the normal "run" contact terminal 38*a* to the first "pulled" contact terminal 38*b*. An electrical contact is established at terminal 38*b* to notify, or inform, the integrated circuit chip 2 of the timepiece 10 that the setting stem 16 is now in the "first pulled" position. As discussed above, when the setting stem 16 is in the "push" position the indicating arm 32*b* electrically contacts the contact terminal 38*c*, and the integrated circuit chip 2 can detect that the setting stem 16 is in the "push" position. In response, the integrated circuit chip 2 activates a feature of the timepiece 10, for example and as discussed above, the device for illuminating the display.

It should be understood that the particular setting positions and, in particular, the functions set thereby are by way of example. That is, one should not interpret the foregoing as limitations to the scope of the present invention. For example, as currently presented, the first "push" position corresponds to the "switch" position which, when invoked, results in the illumination of the display 6. It should be appreciated that it is within the scope of the present invention for the "switch" functionality, i.e., the illumination of the display 6, to be activated when, for example, a second "pushed" position is invoked.

As should also be appreciated from the above description of the components of the present invention, the direction of rotation as well as a rate of rotation of the setting stem 16 provides supplemental rotational setting positions to corresponding ones of the plurality of axial setting positions of the electronic timepiece 10. Thus, by detecting a rate of clockwise rotation of the setting stem 16 during a setting function, a value displayed by the timepiece 10 during a predetermined setting function is incrementally increased through a series of predefined values. The rate of incremental increase (or decrease) preferably corresponds directly to the rate of clockwise (or counterclockwise) rotation of the setting stem 16. Similarly, as was discussed above, a preferred construction or configuration of the teeth 26 of the setting stem 16 and the intermediate portion 20*a* of the spring switch arm 20 influence the rate of incremental increase or decrease through the predetermined series of values. That is, the rate at which the setting stem 16 is rotated and/or the configuration of teeth (e.g. the number of teeth) can dictate the rate at which a current value is replaced by a next value in a series of predefined values. Similarly, by detecting a rate of counterclockwise rotation of the setting stem 16, a value displayed by the timepiece 10 during the predetermined setting function may be incrementally decreased through a series of predefined values at a rate corresponding directly to the rate of counterclockwise rotation of the setting stem 16. The detection techniques and incremental updating of values are discussed in further details below.

Figure 3:
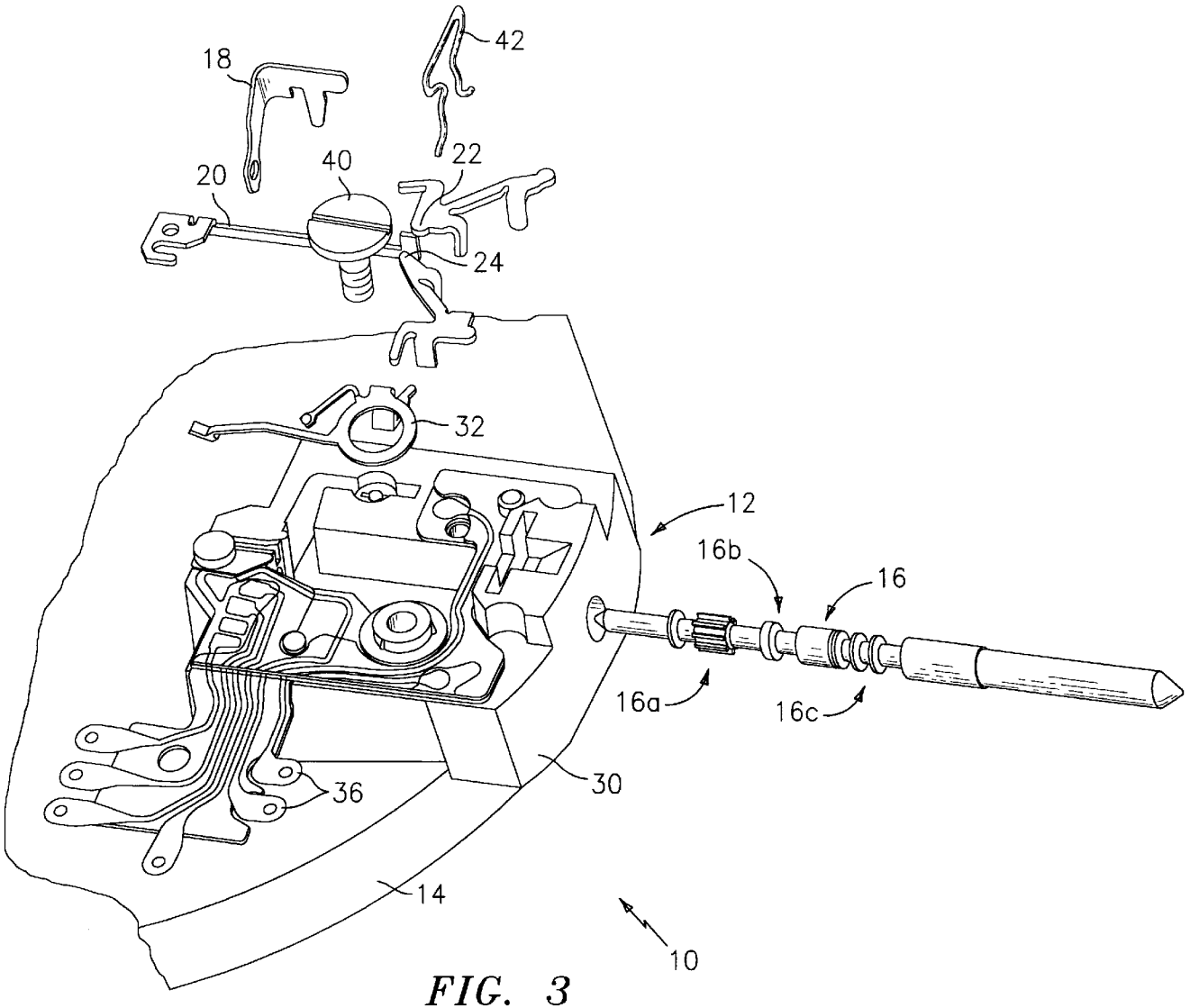
FIG. 3 is an enlarged, exploded view illustrating a layer construction of a crown switching mechanism constructed in accordance with the present invention.

Referring now to FIG. 3, an exploded prospective view of the above-described components of the crown switching mechanism 12 is shown. In particular, FIG. 3 shows how these components are assembled in a layered construction and secured in place, for example by a screw 40, within a body portion 30 of the crown switching mechanism 12 and the movement frame 14 of the timepiece 10. FIG. 3 also illustrates a preferred configuration of the setting stem 16 where the setting stem 16 includes the first portion 16*a* having the plurality of teeth 26, the second portion 16*b* having the slot for retaining the finger portion 32*a* of the function lever 32, and a third portion 16*c* having a plurality of ring-shaped grooves which, as discussed below, cooperate with the detent spring 42 for providing the plurality of axial setting positions of the setting stem 16.

Figure 4:
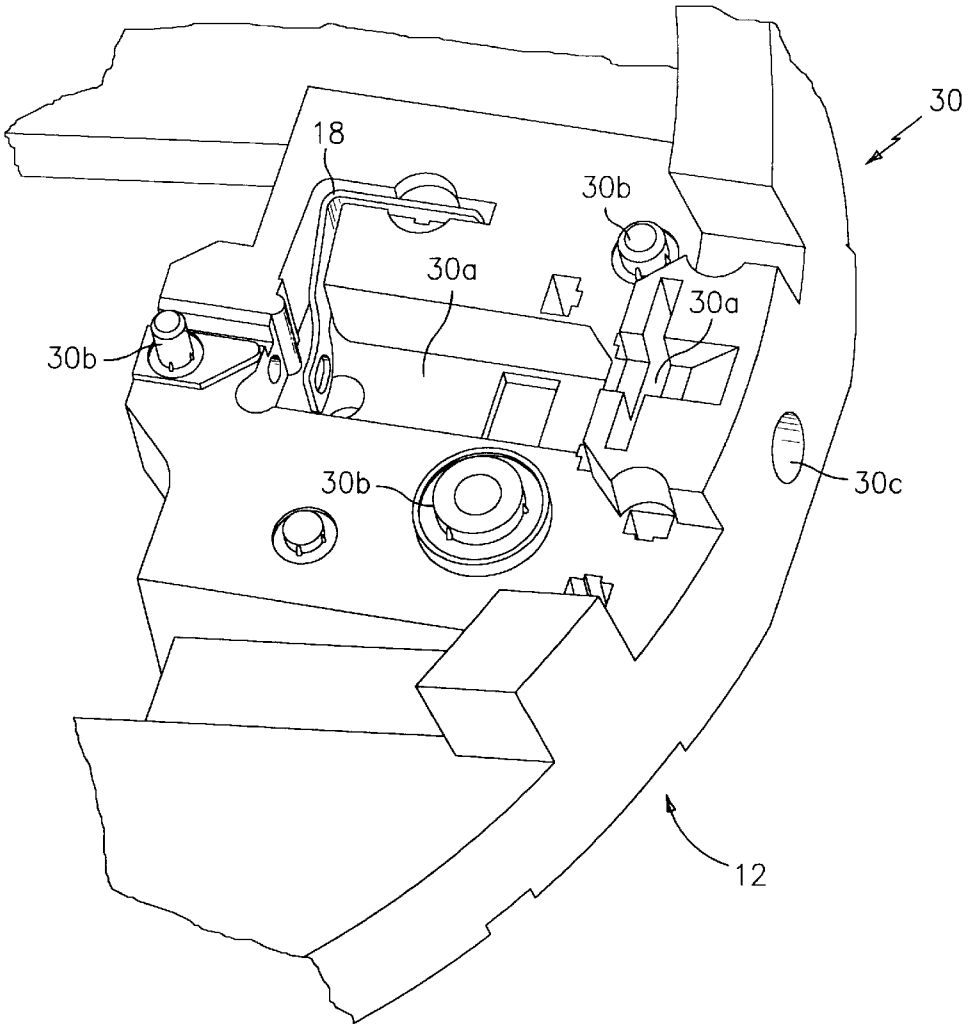
FIG. 4 is a perspective view illustrating a first layer of the crown switching mechanism with certain components removed for ease of illustration.

In FIG. 4, a preferred embodiment of the body portion 30 is shown. The body portion 30 includes a plurality of cavities 30*a* and forms, or protrusions 30*b*, for retaining the components of the crown switching mechanism 12. In particular, FIG. 4 illustrates a first layer of the switching mechanism 12 construction which includes the spring plate 18 inserted in one of the cavities 30*a* of the body portion 30 of the watch case.

Figure 5:
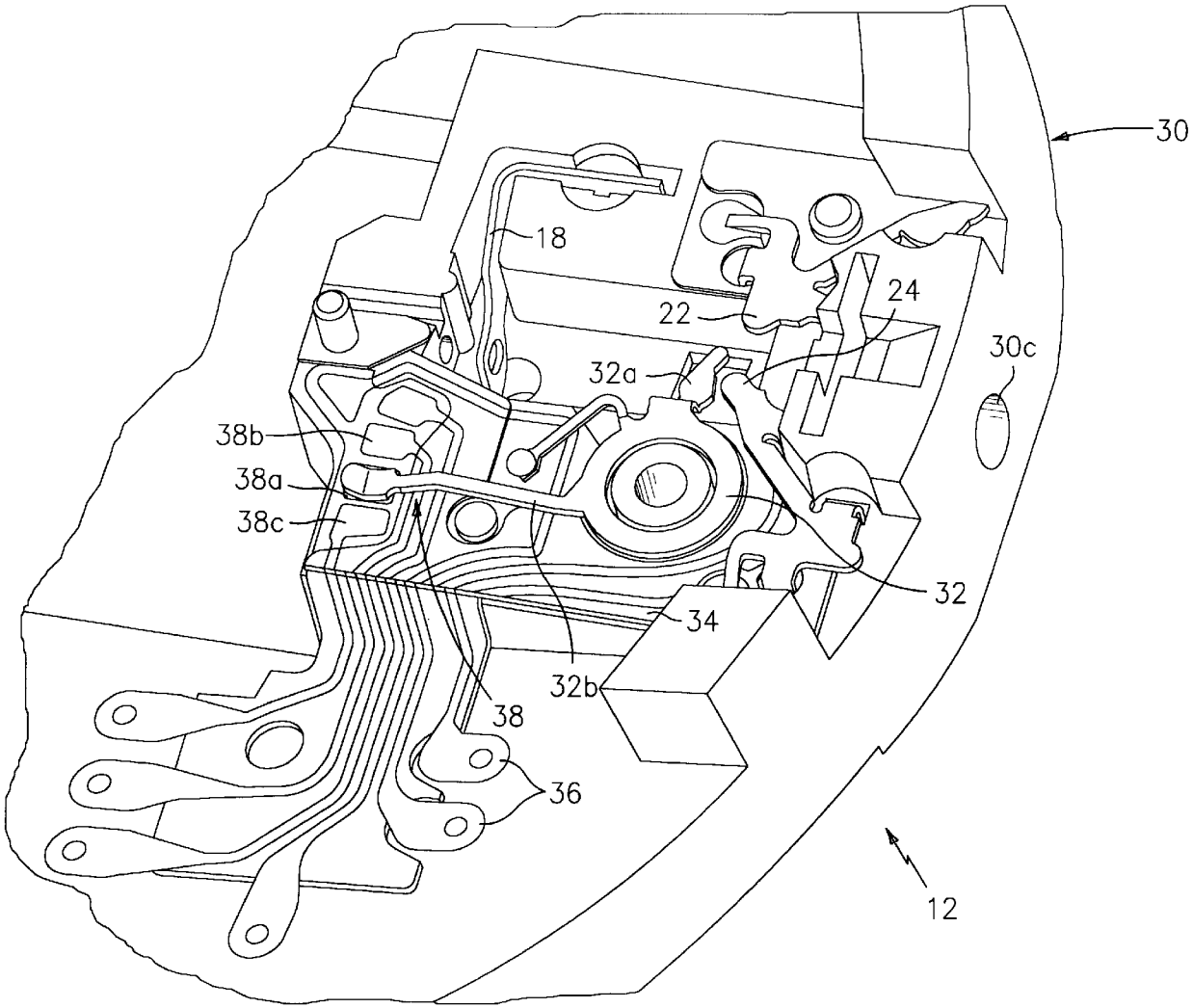
FIG. 5 is a perspective view illustrating a second layer of the crown switching mechanism with certain components added for ease of illustration.

Referring now to FIG. 5, a next layer of the crown switching mechanism 12 construction is illustrated. The next layer comprises the PCB 34, the function lever 32 and the first and the second electrical contacts 22 and 24. As shown, in the preferred embodiment, the PCB 34 is located about the protrusions 30*b* of the body portion 30, while the function lever 32 is aligned to form an electrical connection with the normal "run" contact terminal 38*a*.

Figure 6:
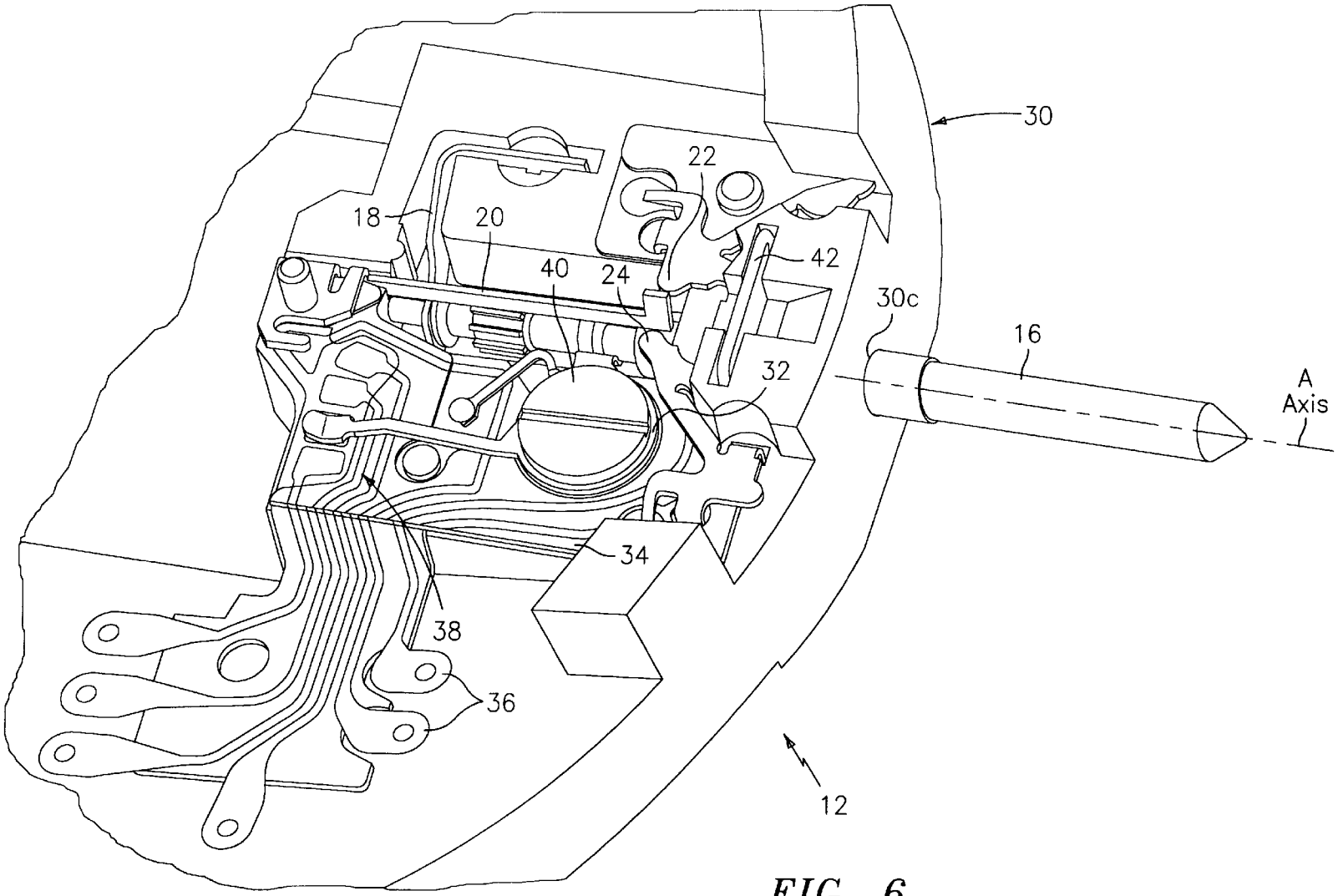
FIG. 6 is a perspective view of the crown switching mechanism of FIG. 5 with the addition of yet certain other components.

With reference to FIG. 6, a final layer of the crown switching mechanism 12 construction is illustrated wherein the setting stem 16 is inserted through a bore 30*c* in the body portion 30 and the spring switch arm 20 is fixedly mounted and parallelly aligned to be in a common plane with an axis of rotation of the setting stem 16 (the A axis). As can be appreciated, and as was discussed above, the second end of the spring switch arm 20 is aligned between the first and the second electrical contacts 22 and 24.

The final layer further includes the detent spring 42. The detent spring 42 cooperates with the ring-shaped grooves of the third portion 16*c* (FIG. 3) of the setting stem 16 to retain the setting stem 16 within the plurality of axial setting positions. In particular, the detent spring 42 cooperates with the third portion 16*c* of the setting stem 16 to prohibit an accidental complete withdrawal of the setting stem 16 from the watch case.

Figure 10:
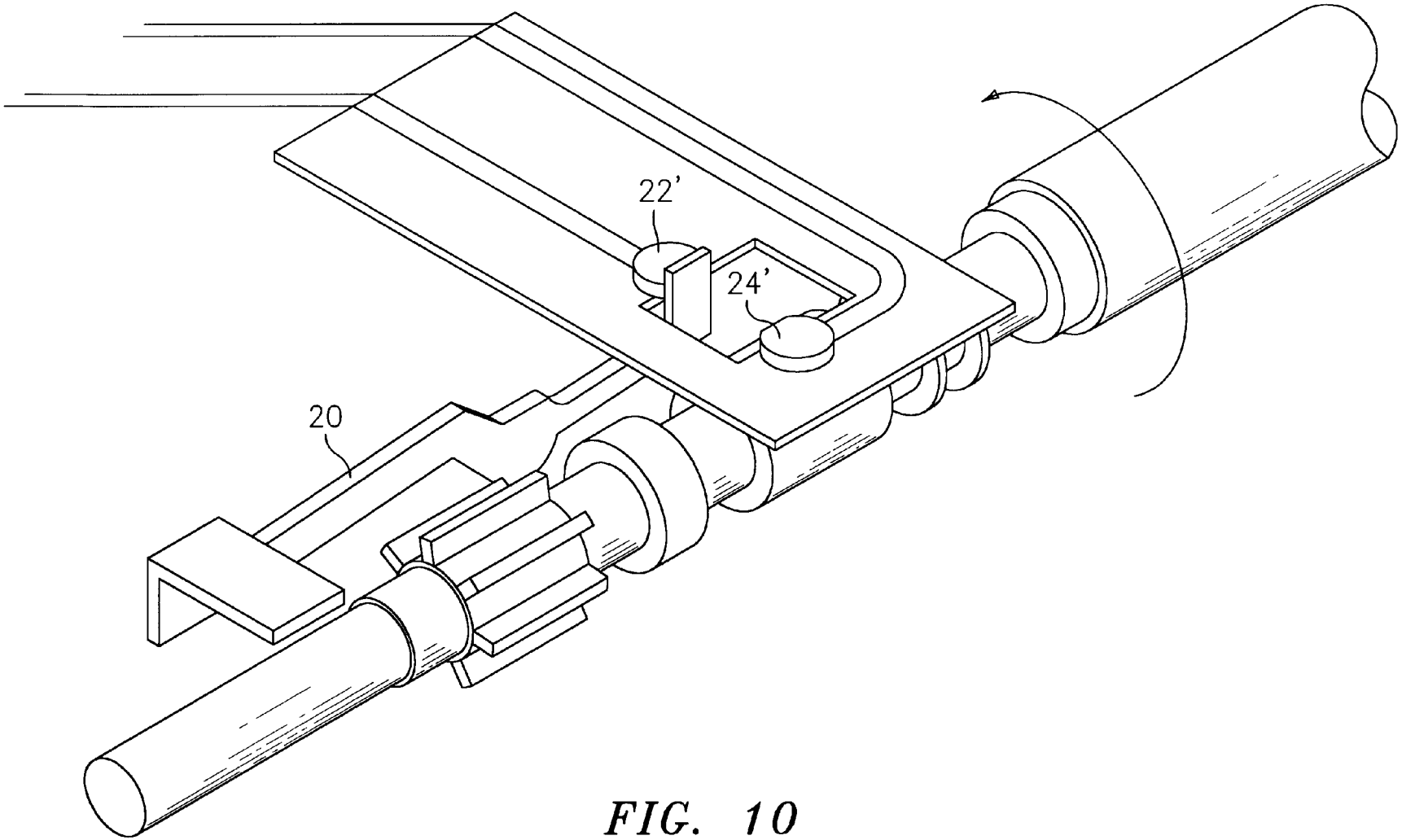
FIG. 10 is an enlarged, perspective view of the crown switching mechanism constructed in accordance with one embodiment of the present invention.

With reference now to FIG. 10 a partial, prospective view of an alternate embodiment of the crown switching mechanism 12 is shown. In particular, the first and the second electrical contacts 22 and 24 are illustrated as rigid electrical contacts 22' and 24' formed on the PCB 34. FIG. 10 also illustrates a perceived advantage of the present invention over prior art switching mechanisms. That is, an achievable travel of the second end of the spring switch arm 20 is greater than the travel of the intermediate portion 20*a* at the point of deflection due to the engagement of the teeth 26 with the intermediate portion 20*a*. By implementing the desired electrical connection at the second end of the spring switch arm 20 the present invention is less sensitive to variations in the positioning of the first and the second electrical contacts 22 and 24 or, in this embodiment, contacts 22' and 24'. Thus, the switching mechanism of present invention is less prone to failure due to variances in manufacturing tolerance which may effect the relative location of the electrical contacts and the spring switch arm 20.

The advantage in reducing the sensitivity of the present invention to variances in manufacturing tolerances is also achievable by virtue of the parallel alignment of the spring switch arm 20 and the setting stem 16 with an axis of rotation of the setting stem 16. As should be appreciated, this alignment reduces the perceived disadvantages in prior art switching mechanism configurations such as is described in the above-referenced U.S. patent to Flumm (U.S. Pat. No. 4,209,976).

Although described in the context of preferred embodiments, it should be realized that a number of modifications to these teachings may occur to one skilled in the art. By example, and as discussed above, the teachings of this invention are not intended to be limited to any specific number or configuration of teeth of the setting stem. Rather, the number and configuration of teeth are dictated by a preferred operating frequency or rate at which values within the predetermined setting functions are to be incrementally updated.

While the invention has been particularly shown and described with respect to preferred embodiments thereof, it will be understood by those skilled in the art that changes in form and details may be made therein without departing from the scope and spirit of the invention.

For example, the present invention has been disclosed above with particular reference to timepieces. However, one skilled in the art shall now appreciate that the present invention is equally applicable, and as claim herein, to devices other than timepieces, such as, but not limited to, clocks, thermostats, such as wall mounted thermostats and security devices, such as wall mounted or handheld devices for the home or office. Therefore, reference to a timepiece should equally be understood to refer to at least any of the aforementioned other devices. That is, the present invention is applicable in any electronic device in which a switching mechanism, such as is disclosed herein, generates intermittent electrical signals during setting functions as set forth above.

What is claimed is:

1. A switching mechanism for a multimode electronic timepiece of the type having a casing, a frame, means for indicating a time-of-day, and an integrated circuit providing at least the time-of-day, the integrated circuit is operable in a plurality of modes a first of which is to set the time-of-day, the switching mechanism comprising:

a setting stem mounted in an opening through the case and the frame, the setting stem being rotationally moveable and operatively positionable in a plurality of axial setting positions in response to axial movement of the setting stem, the setting stem having at least one tooth disposed thereon;

a single switch arm spaced apart from and parallelly aligned with the setting stem, the switching arm having a first end fixedly coupled within a cavity of the frame, a second end and an intermediate portion between the first and the second ends for engaging the at least one tooth of the setting stem;

a first electrical contact and a second electrical contact spaced apart from the first electrical contact;

wherein when the setting stem is in a first of the plurality of axial setting positions, the electronic timepiece is in the first mode and the intermediate portion is intermittently engagable with the at least one tooth;

wherein when the setting stem is in a second of the plurality of axial setting positions, the electronic timepiece is in at least a second mode and the intermediate portion is intermittently engagable with the at least one tooth;

and wherein when said setting stem is in one of the first and the second axial positions and rotated in a first direction, the intermediate portion intermittently engages the at least one tooth causing deflection of the second end of the switch arm in a first deflected direction thereby causing intermittent electrical connections between the second end and the first electrical contact, and when the setting stem is rotated in a second direction, the intermediate portion intermittently engages the at least one tooth causing deflection of the second end of the switch arm in a direction opposite to the first deflected direction thereby causing intermittent electrical connections between the second end and the second electrical contact;

whereby the intermittent electrical connections between the second end and the first electrical contact produces corresponding intermittent first electrical pulses and the intermittent electrical connections between the second end and the second electrical contact produces corresponding intermittent second electrical pulses.

2. The switching mechanism as in claim 1, wherein the integrated circuit is responsive to each electrical connection of the second end of the switch arm with the first electrical contact for incrementing the time-of-day exhibited on the means for indicating of the timepiece and responsive to each electrical connection of the second end of the switch arm with the second electrical contact for decrementing the time-of-day exhibited on the means for indicating of the timepiece.

3. The switching mechanism as in claim 1, wherein the intermediate portion of the switch arm includes at least one protruding portion and the at least one tooth of the setting stem is sufficiently elongated so as to intermittently engage the at least one protruding portion when the setting stem is in at least the first and the second axial setting positions.

4. The switching mechanism as in claim 1, wherein the intermediate portion of the switch arm includes at least one protruding portion and the setting stem includes at least two sets of teeth disposed over a length of the setting stem and spaced apart by at least one smooth portion, and wherein when the setting stem is in at least one axial setting position the at least one protruding portion intermittently engages one of the at least two sets of teeth thereby producing one of the first and the second electrical pulses, and when the setting stem is in at least one other axial setting position the at least one protruding portion cooperates with the at least one smooth portion to prevent production of the first and the second electrical pulses.

5. The switching mechanism as in claim 4, wherein the at least two sets of teeth are comprised of n sets of teeth and the at least one smooth portion is comprised of n-1 smooth portions, and wherein n is an integer in a range of about 2 to 4.

6. The switching mechanism as in claim 1, wherein the intermediate portion of the switch arm includes at least one protruding portion sufficiently elongated so as to intermittently engage the at least one tooth when the setting stem is in at least the first and the second axial setting positions.

7. The switching mechanism as in claim 1, wherein the intermediate portion of the switch arm includes at least two protruding portions spaced apart by a smooth portion, and wherein when the setting stem is in at least one axial setting position the at least one tooth intermittently engages one of the at least two protruding portions, and when the setting stem is in at least one other axial setting position the at least one tooth cooperates with the smooth portion to prevent engagement between the at least one tooth and one of the at least two protruding portions.

8. The switching mechanism as in claim 1, wherein the setting stem includes a plurality of teeth disposed thereon for engaging the intermediate portion of the switch arm.

9. The switching mechanism as in claim 1, wherein the first electrical contact and the second electrical contact are rigid electrical contacts disposed on the circuitry.

10. A switching mechanism for a multimode electronic timepiece of the type having a casing, a frame, means for indicating a time-of-day and an integrated circuit, the integrated circuit being operable in a plurality of modes, the switching mechanism comprising:

a setting stem mounted in an opening through the case and the frame, the setting stem being rotationally moveable and operatively positionable in a plurality of axial setting positions in response to axial movement of the setting stem, the setting stem having at least one tooth disposed thereon;

a single switch arm spaced apart from and parallelly aligned with the setting stem, the switch arm having a first end fixedly coupled within a cavity of the frame, a second end and an intermediate portion between the first and the second ends for engaging the at least one tooth of the setting stem;

a first electrical contact and a second electrical contact spaced apart from the first electrical contact;

wherein when the setting stem is in a first of the plurality of axial setting positions the electronic timepiece is operating in a first mode, and when the setting stem is in at least a second of the plurality of axial setting positions the electronic timepiece is operating in at least a second mode; and wherein when in the first mode the intermediate portion cooperates with the at least one tooth to intermittently generate an intermittent first electrical pulse in response to a rotation of the setting stem in a first direction as the second end is caused to deflect in a first deflecting direction and contact the first electrical contact, and when in the second mode the intermediate portion cooperates with the at least one tooth to intermittently generate an intermittent second electrical pulse in response to a rotation of the setting stem in a second direction as the second end is caused to deflect in a direction opposite the first deflecting direction and contact the second electrical contact.

11. The switching mechanism as in claim 10, wherein the integrated circuit is responsive to the first and the second intermittent electrical pulses during setting functions of at least one of the plurality of modes.

12. The switching mechanism as in claim 10, wherein the setting stem includes a plurality of teeth integrally formed thereon for engaging the intermediate portion of the switch arm.

13. A switching mechanism for a multimode electronic device of the type having a casing, a frame, and an integrated circuit operable in a plurality of modes a first of which is an information setting mode, the switching mechanism comprising:

a setting stem mounted in an opening through the case and the frame, the setting stem being rotationally moveable and operatively positionable in a plurality of axial setting positions in response to axial movement of the setting stem, the setting stem having at least one tooth disposed thereon;

a single switch arm spaced apart from and parallelly aligned with the setting stem, the switch arm having a first end fixedly coupled within a cavity of the frame, a second end and an intermediate portion between the first and the second ends for engaging the at least one tooth of the setting stem;

a first electrical contact and a second electrical contact spaced apart from the first electrical contact;

wherein when the setting stem is in a first of the plurality of axial setting positions, the electronic device is in the first mode and the intermediate portion is intermittently engagable with the at least one tooth;

wherein when the setting stem is in a second of the plurality of axial setting positions, the electronic device is in at least a second mode and the intermediate portion is intermittently engagable with the at least one tooth;

and wherein when said setting stem is in one of the first and the second axial positions and rotated in a first direction, the intermediate portion intermittently engages the at least one tooth causing deflection of the second end of the switch arm in a first deflected direction thereby causing intermittent electrical connections between the second end and the first electrical contact, and when the setting stem is rotated in a second direction, the intermediate portion intermittently engages the at least one tooth causing deflection of the second end of the switch arm in a direction opposite to the first deflected direction thereby causing intermittent electrical connections between the second end and the second electrical contact;

whereby the intermittent electrical connections between the second end and the first electrical contact produces corresponding intermittent first electrical pulses and the intermittent electrical connections between the second end and the second electrical contact produces corresponding intermittent second electrical pulses.

14. A switching mechanism for a multimode electronic device of the type having a casing, a frame, and an integrated circuit operable in a plurality of modes, the switching mechanism comprising:

a setting stem mounted in an opening through the case and the frame, the setting stem being rotationally moveable and operatively positionable in a plurality of axial setting positions in response to axial movement of the setting stem, the setting stem having at least one tooth disposed thereon;

a single switch arm spaced apart from and parallelly aligned with the setting stem, the switch arm having a first end fixedly coupled within a cavity of the frame, a second end and an intermediate portion between the first and the second ends for engaging the at least one tooth of the setting stem;

a first electrical contact and a second electrical contact spaced apart from the first electrical contact;

wherein when the setting stem is in a first of the plurality of axial setting positions the electronic device is operating in a first mode, and when the setting stem is in at least a second of the plurality of axial setting positions the electronic timepiece is operating in at least a second mode; and wherein when in the first mode the intermediate portion cooperates with the at least one tooth to intermittently generate an intermittent first electrical pulse in response to a rotation of the setting stem in a first direction as the second end is caused to deflect in a first deflecting direction and contact the first electrical contact, and when in the second mode the intermediate portion cooperates with the at least one tooth to intermittently generate an intermittent second electrical pulse in response to a rotation of the setting stem in a second direction as the second end is caused to deflect in a direction opposite the first deflecting direction and contact the second electrical contact.

* * * * *